US009082254B2

(12) United States Patent
Carpentier et al.

(10) Patent No.: US 9,082,254 B2
(45) Date of Patent: Jul. 14, 2015

(54) VENDOR

(75) Inventors: Bart Carpentier, Zoersel (BE); Jurgen Roekens, Kampenhout (BE); Antonio Feltrin, Castelletto Monferrato (IT); Willy Van Esch, Grez-Doiceau (BE); Jacobus Petrus Maria Dessing, CV Hoofddorp (NL)

(73) Assignee: The Coca-Cola Company, Atlanta, GA (US)

( * ) Notice: Subject to any disclaimer, the term of this patent is extended or adjusted under 35 U.S.C. 154(b) by 737 days.

(21) Appl. No.: 12/969,668

(22) Filed: Dec. 16, 2010

(65) Prior Publication Data

US 2011/0226794 A1 Sep. 22, 2011

Related U.S. Application Data

(63) Continuation-in-part of application No. 12/724,477, filed on Mar. 16, 2010.

(51) Int. Cl.
*G07F 11/24* (2006.01)
*G07F 11/32* (2006.01)

(52) U.S. Cl.
CPC ..... *G07F 11/24* (2013.01); *G07F 11/32* (2013.01)

(58) Field of Classification Search
USPC ..... 221/69, 89, 123, 124, 131, 151, 153, 221/154, 208, 246, 247, 263, 266, 268, 277
See application file for complete search history.

(56) References Cited

U.S. PATENT DOCUMENTS

| | | | | |
|---|---|---|---|---|
| 1,841,926 | A * | 1/1932 | Zuehl | 221/75 |
| 3,110,417 | A | 11/1963 | Wingate et al. | |
| 3,390,754 | A | 7/1968 | Newberry | |
| 3,550,810 | A | 12/1970 | Ambrose | |
| 3,837,528 | A * | 9/1974 | Rakucewicz | 221/114 |
| 4,809,879 | A * | 3/1989 | Hanley | 221/125 |
| 5,967,364 | A * | 10/1999 | Swanson et al. | 221/6 |
| 6,321,936 | B1 * | 11/2001 | Feltrin | 221/251 |
| 6,415,953 | B1 * | 7/2002 | O'Brien et al. | 221/196 |
| 7,513,390 | B2 * | 4/2009 | Artsiely | 221/152 |
| 2005/0127014 | A1 * | 6/2005 | Richter et al. | 211/59.2 |
| 2011/0301749 | A1 | 12/2011 | Hammonds et al. | |

FOREIGN PATENT DOCUMENTS

| | | |
|---|---|---|
| GB | 1220295 | 1/1971 |

OTHER PUBLICATIONS

PCT, Title: International Preliminary Report on Patentability, pp. 1-6.

* cited by examiner

*Primary Examiner* — Gene Crawford
*Assistant Examiner* — Kelvin L Randall, Jr.
(74) *Attorney, Agent, or Firm* — Sutherland Asbill & Brennan LLP

(57) ABSTRACT

The present application provides a product vending module for vending a number of products. The product vending module may include a product row, a product gate positioned about the product row, and a product locking system in communication with the product gate. The product locking system may include a latch and a biased base such that releasing the latch allows the product gate to be opened and one of the number of products to be removed therefrom.

17 Claims, 10 Drawing Sheets

VENDOR

RELATED APPLICATIONS

The present application is a continuation-in-part of U.S. Ser. No. 12/724,477, entitled "Vendor", filed on Mar. 16, 2010, now pending. U.S. Ser. No. 12/724,477 is incorporated herein by reference in full.

TECHNICAL FIELD

The present application relates generally to vending machines and mechanisms and more particularly relates to simplified vending mechanisms positioned within a cooler.

BACKGROUND OF THE INVENTION

Traditional vending machines generally are intended to be positioned in locations of moderate to heavy consumer traffic. Locations with less consumer traffic, such as certain offices, hospitals, schools, retail establishments, and the like, may not be well suited for the usual size and expense related to the use of a traditional vending machine. Specifically, the components of the vending machine, such as the vending mechanism, the refrigeration equipment, the payment equipment, the product stocks, and the like, may be relatively expensive to provide and operate. Moreover, the size of the traditional vending machine may result in a slow rotation of product through the vending machine.

Coolers, particularly glass door coolers, may be somewhat less expensive to provide and operate given the lack of at least the vending mechanism. Glass door coolers also generally offer the advantage of allowing the consumer to see the products available within the cooler. Such visibility may provide the opportunity to promote the products therein and also may promote impulse purchases. The lack of the vending mechanism, however, generally means that the removal of products from the cooler cannot always be controlled.

There is thus a desire therefore for improved vending machine. Such a vending machine may offer the positive features of a glass door cooler but with appropriate vending controls. Further, such an improved vending machine should be less expensive to provide and operate as compared to a traditional vending machine and the like.

SUMMARY OF THE INVENTION

The present application thus provides a product vending module for vending a number of products. The product vending module may include a product row, a product gate positioned about the product row, and a product locking system in communication with the product gate. The product locking system may include a latch and a biased base such that releasing the latch allows the product gate to be opened and one of the number of products to be removed therefrom.

The present application further provides a method of vending a number of products. The method may include the steps of providing a number of product vending modules, detecting the movement of a product door of one of the number of product vending modules, releasing a latch so as to permit the product door to be opened completely, locking the remaining product vending modules, and allowing the product door to close.

The present application further provides a vendor for vending a number of products. The vendor may include a number of product vending modules with each product vending module including a door in communication with a product locking system. The vendor also may include a control in communication with each of the product vending modules such that when the control detects movement of a first door of one of the product vending modules, the control allows the first door to open completely and locks the remaining product vending modules.

These and other features and improvements of the present application will become apparent to one of ordinary skill in the art upon review of the following detailed description when taken in conjunction with the several drawings and the appended claims.

DETAILED DESCRIPTION

The present application concerns the vending of any number of products 10. Although the products 10 are shown, by way of example only, in the form of cans 20, it is understood that the products 10 may include any type or size of container including, but not limited to, cans, bottles, pouches, boxes, wrapped items, and/or any type of rigid or flexible packaging. The products 10 may include beverages, food items, non-food items, consumer products, and/or any type of product 10 that may be vended. The scope of the application is in no way limited by the nature of the products 10 intended to be vended herein or otherwise. Similarly, while one use herein is for a chilled product 10, it will be understood that the products 10 herein may be at ambient temperatures, elevated temperatures, or at any temperature.

Figure 1:
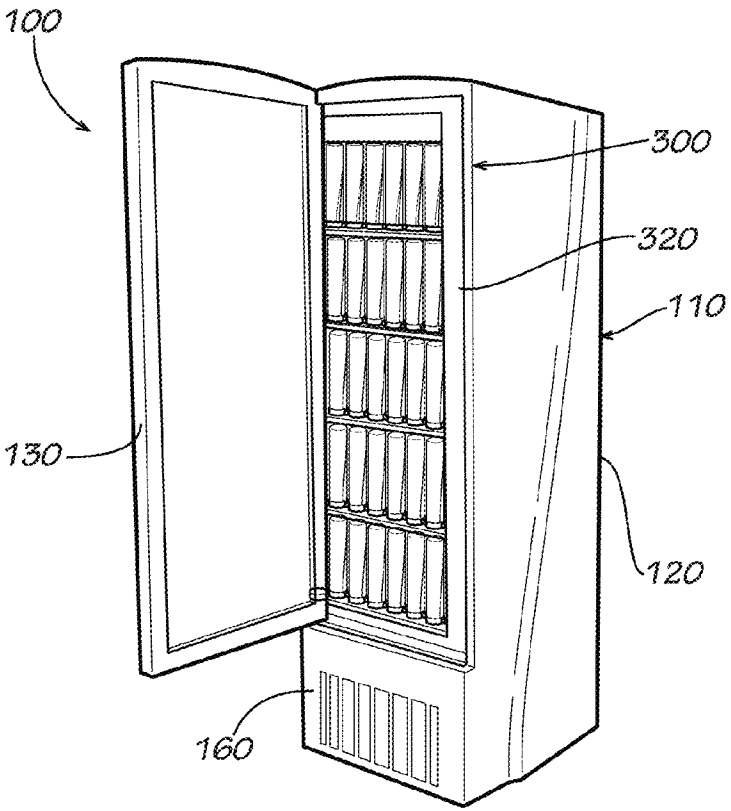
FIG. 1 is a perspective view of a vendor as may be described herein.

Referring now to the drawings, in which like numerals refer to like elements throughout the several views, FIG. 1 shows a vendor 100 as may be described herein. The individual components of the vendor 100 described in detail below may be generally modular in nature. As such, the various components may be original equipment and/or retrofitted as desired. Likewise, not all of the components may be required to operate the vendor 100 as a whole. Rather, many alternative configurations may be used herein. The vendor 100 may be primarily intended for indoor use but may be located anywhere adjacent to an electrical power source and the like.

Figure 2:
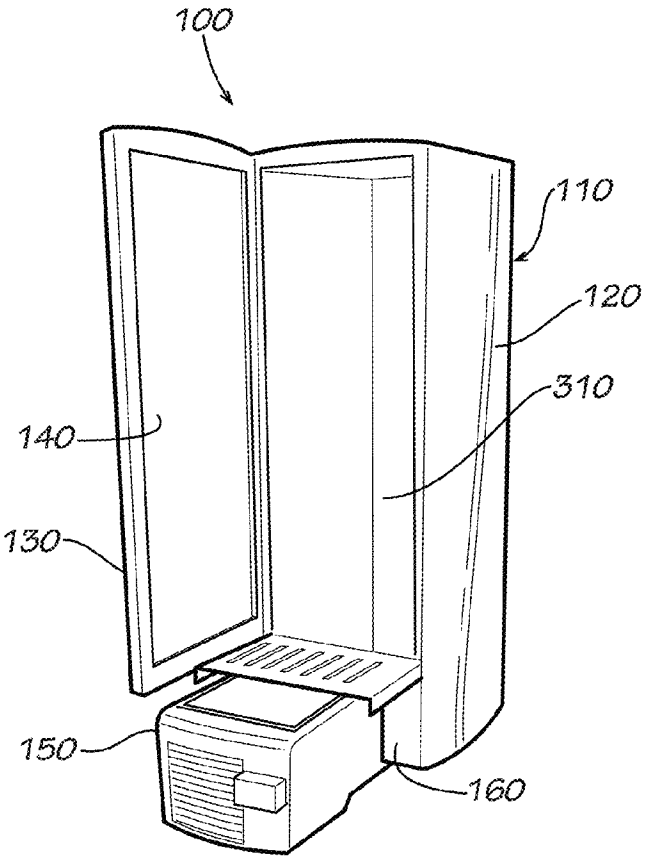
FIG. 2 is a perspective view of a cooler that may be used with the vendor of FIG. 1.

The vendor 100 may include a cooler 110. As is shown in FIG. 2, the cooler 110 may include an outer frame 120 enclosed by a door 130. The frame 120 and the door 130 may be largely of conventional design and may be insulated as desired. The door 130 may include a transparent panel 140 therein. The transparent panel 140 may be made out of glass and the like. The door 130 may swing open and may include a lock or other type of anti-tamper mechanisms thereon. The cooler 110 may have any desired size or shape.

The vendor 100 also may include a refrigeration/heating cassette 150 positioned within the cooler 110. Specifically, the refrigeration/heating cassette 150 may be positioned within a refrigeration/heating compartment 160 of the frame 120 or otherwise. The refrigeration/heating cassette 150 may be modular and may be of conventional design. An example of the refrigeration/heating cassette 150 is shown in commonly owned U.S. Pat. No. 7,117,689, entitled "Removable Refrigeration Cassette for a Hot and Cold Vending Machine" to Rudick, et al. U.S. Pat. No. 7,117,689 is incorporated herein by reference in full. Other types of heating and/or refrigeration devices may be used herein. Refrigeration, heating, and/or both thus may be provided herein.

Figure 3:
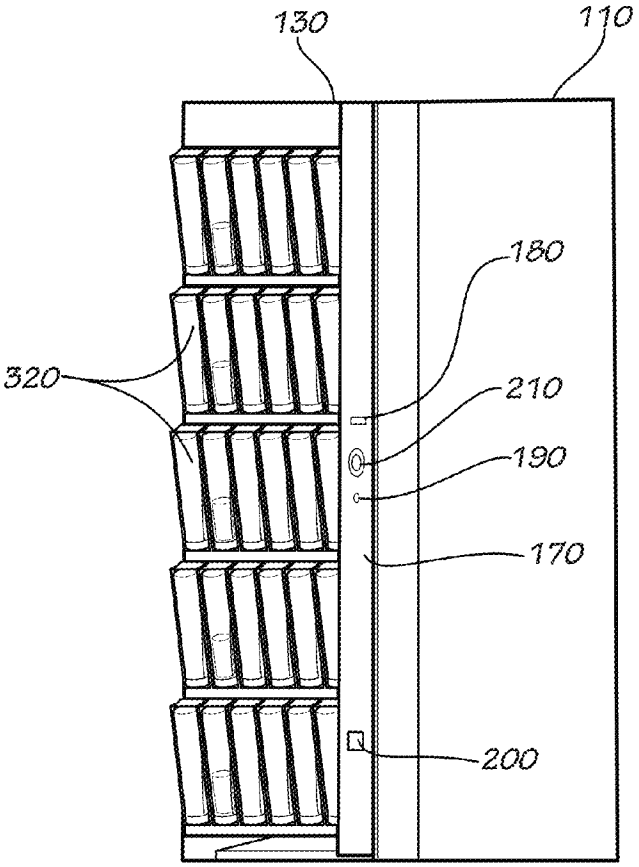
FIG. 3 is a perspective view of the vendor of FIG. 1 with a payment device.

The vendor 100 also may include a payment device 170. The components of the payment device 170 may be positioned about the frame 120 and the door 130 of the cooler 110. Specifically as is shown in FIG. 3, the door 130 may include a money slot 180, a money return button 190, and a money return holder 200. A status display panel 210 also may be positioned on the door 130. These and other components of the payment device 170 positioned on the door 130 in turn may cooperate with the components positioned within the frame 120.

Figure 4:
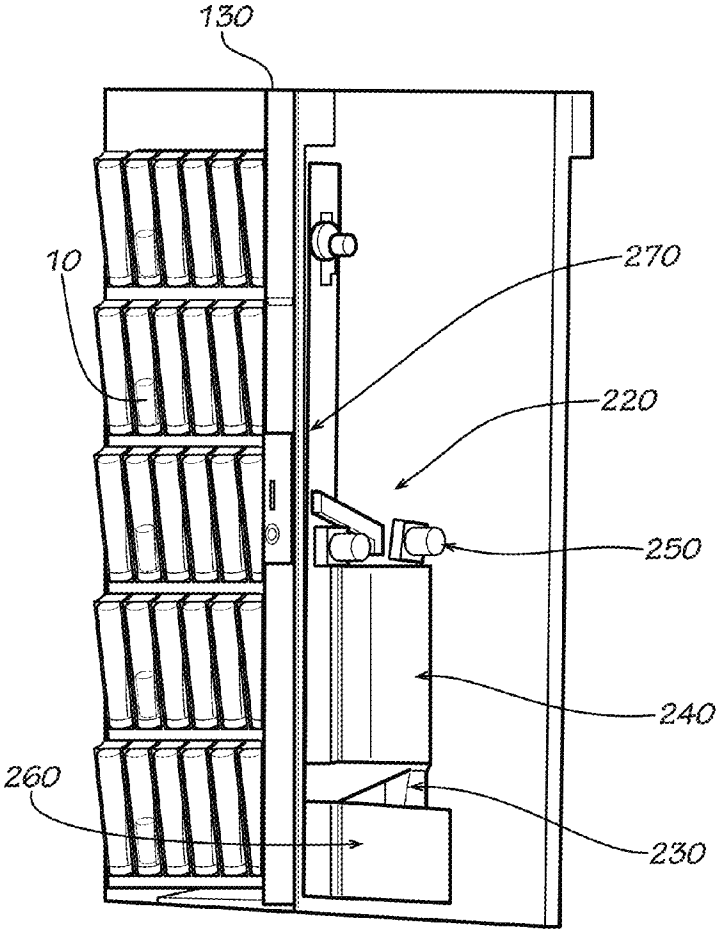
FIG. 4 is perspective view of the vendor of FIG. 1 showing the payment device with a side frame door open.

As shown in FIG. 4, these components may include a money channel 220 in communication with the money slot 180 and a money return channel 230 in communication with the money return holder 200. Also positioned about the frame 120 may be a payment system 240, a money return unit 250, and a money box 260. The components of the payment device 170 may be controlled by an electronic control 270. The electronic control 270 may be a conventional programmable microprocessor and the like. The electronic control 270 also may communicate with other components of the overall vendor 100 as will be described in more detail below. The payment device 170 also may include other or different components and other or different configurations.

The vendor 100 further may include a vending device 300. The vending device 300 may be positioned within a vending compartment 310 of the cooler 100. The vending device 300 and the vending compartment 310 may be in communication with the refrigeration/heating cassette 150 positioned within the refrigeration/heating compartment 160. The vending device 300 may have any size or shape. Other configurations may be used herein.

Figure 5:
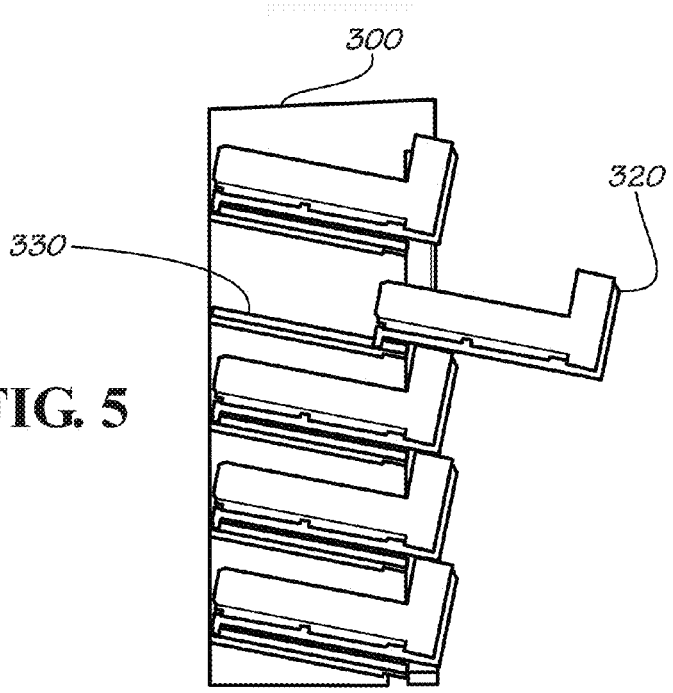
FIG. 5 is a side perspective view of a number of product shelves of the vending device that may be used with the vendor of FIG. 1.

As is shown in FIGS. 1 and 5, the vending device 300 may include a number of product shelves 320. The product shelves 320 may be positioned on a pair of fixed guides 330 or otherwise. The product shelves 320 may be slidable within the fixed guide 330 so as to provide for easy first in, first out loading for the products 10 and also to remove the product shelves 320 themselves. One or more of the product shelves 320 may be positioned at an angle from back to front so as to promote self feeding of the products 10 therein via gravity. Other types of shelf configurations also may be used herein.

Figure 6:
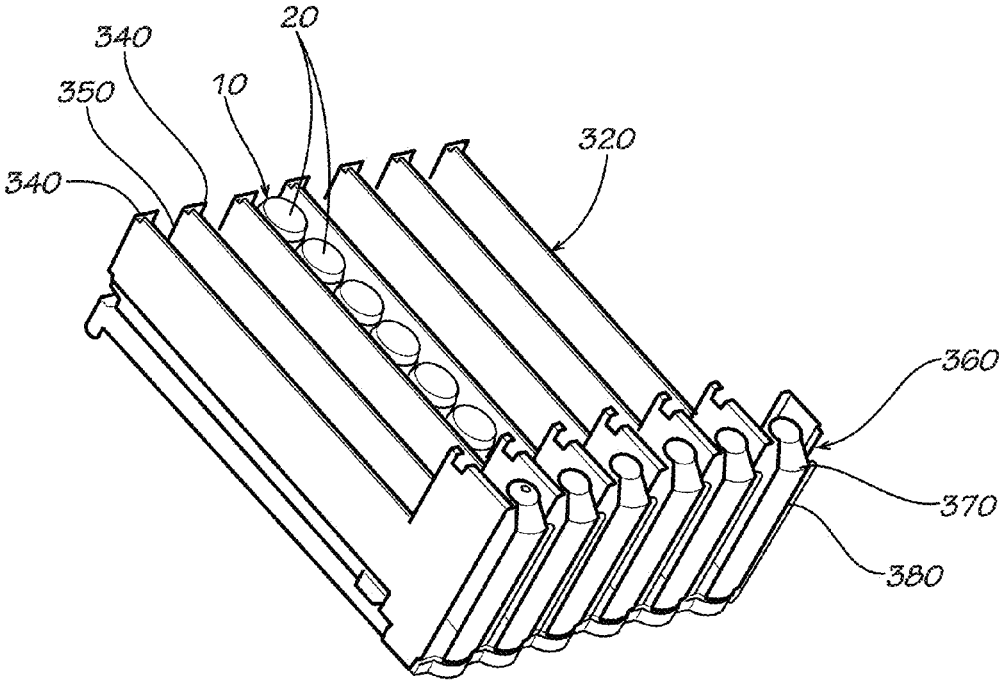
FIG. 6 is a perspective view of a product shelf.

FIG. 6 shows one of the product shelves 320. Each product shelf 320 may have a number of lateral walls 340 that define a number of product rows 350. Any number of product rows 350 may be used. Likewise, the product rows 350 may have any dimension. Different sizes and shapes of product rows 350 also may be used together. As is shown, a number of the products 10 may be positioned within each of the product row 350.

The lower end of each product row 350 may include a product gate system 360. The product gate system 360 ensures that only one product 10 is removed from the product shelf 320 during each vend. Each of the product gate systems 360 includes a product gate 370. The product gate 370 preferably may be made from a transparent material such that the products 10 therein may be visible in whole or in part. The product gate 370 may have a somewhat convex shape and may extent for about the length of the product 10 intended to be positioned therein. Other shapes and sizes may be used herein. Each product gate 370 includes a largely vertically extending door 380 positioned on a pivoting base 390. The pivoting base 390 may be attached to the end of the product row 350. Although the base 390 is shown as largely circular in shape, any size or shape may be used herein.

Figure 8:
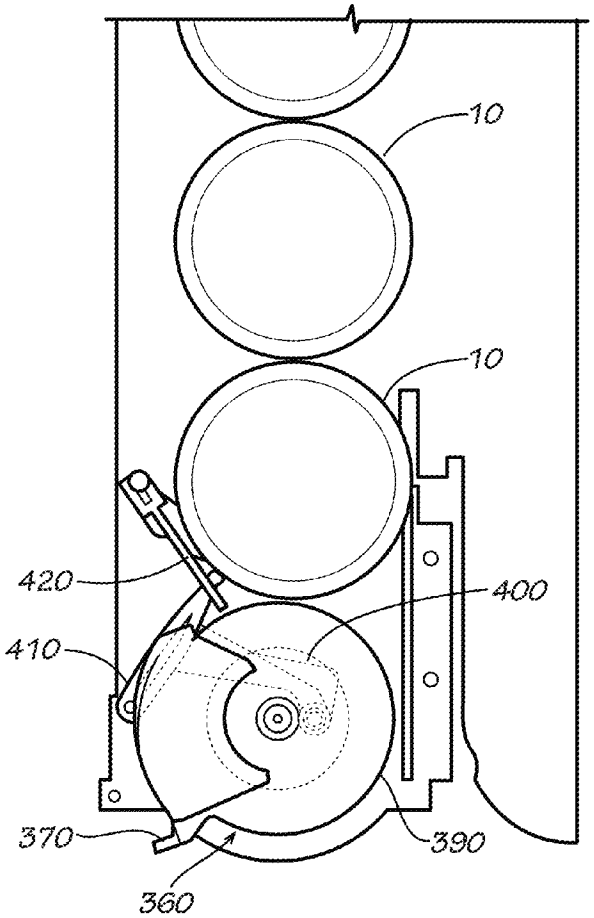
FIG. 8 is a top plan view of the product gate system in a blocked position.
Figure 7:
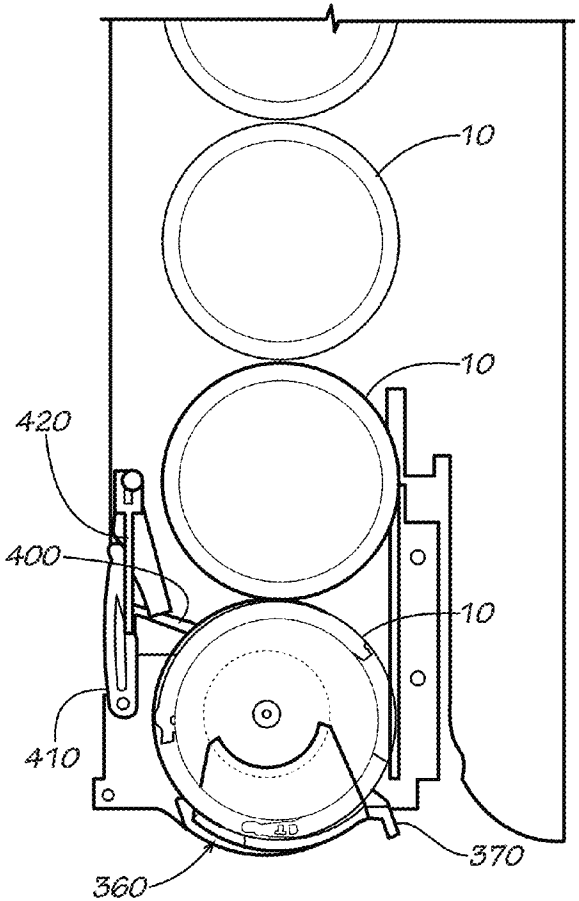
FIG. 7 is a top plan view of a product gate system in a closed position.

As is shown in FIGS. 7 and 8, the product gate system 360 also may include a number of levers, a first lever 400 and a second lever 410. The first lever 400 may be attached to the base 390 and pivots therewith so as to pull the second lever 410 along as the base 390 rotates. The second lever 410 in turn pulls a flap 420. The second flap 420 serves to block the following product 10 once the first product in the product row 350 is removed from the base 390. Specifically, the levers 400, 410 rotate the flap 420 into contact with the next product 10 once the product gate 370 is rotated open. The terms "lever" and "flap" simply refer to any type of extended member and may have any size of shape. Other configurations may be used herein.

Figure 10:
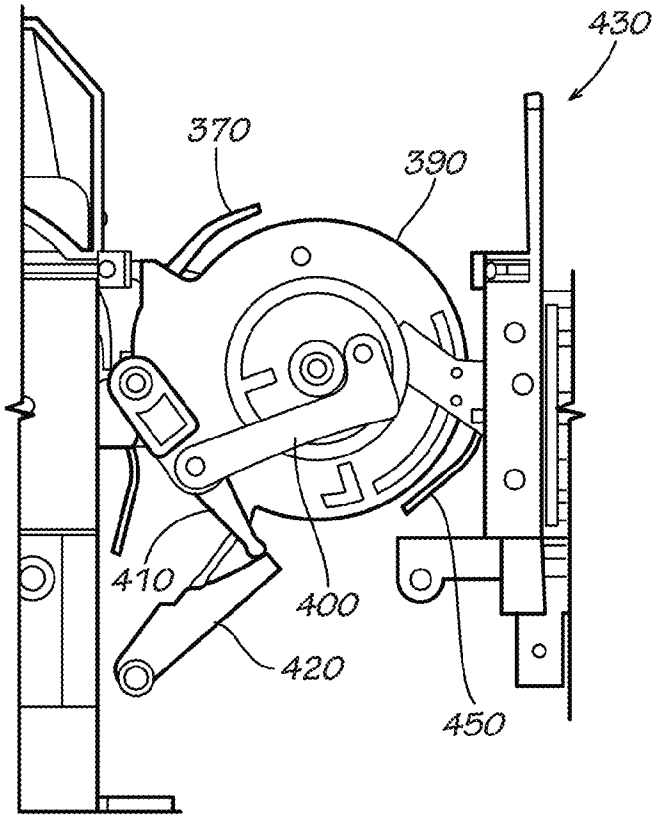
FIG. 10 is a top plan view of the alternative product gate system in a blocked position.
Figure 9:
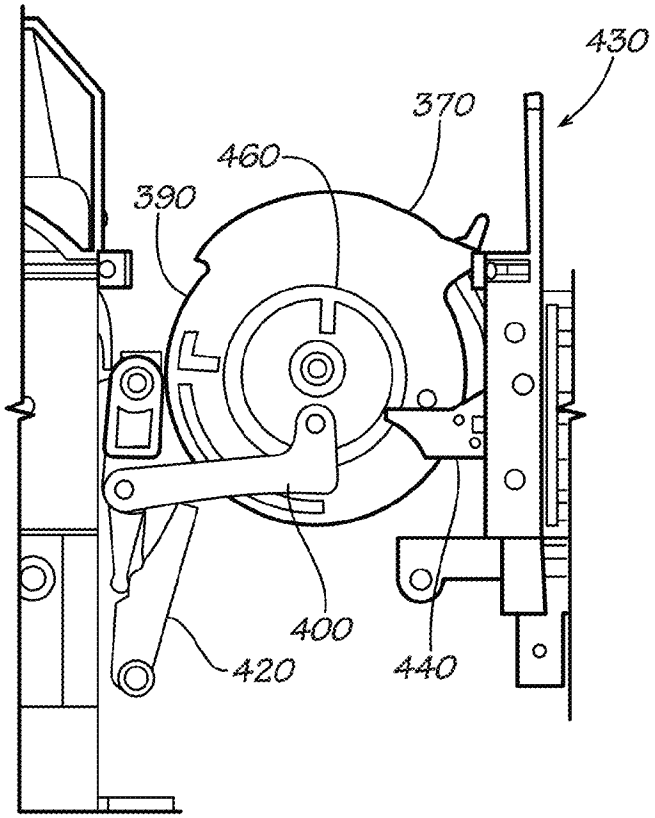
FIG. 9 is an alternative embodiment of a product gate system in a closed position.

FIGS. 9 and 10 show a further embodiment of a product gate system 430. The system 430 also uses the first lever 400, the second lever 410, and the flap 420. This system 430 also uses a third lever 440 attached to a second flap 450, One end of the third lever 440 rides along a circular rib 460 positioned on the base 390. Rotation of the base 390 pivots the third lever 440 and the accompanying second flap 450 an as to provide a further barrier to the next product 10 in the row 350. Other configurations may be used herein.

Figure 11:
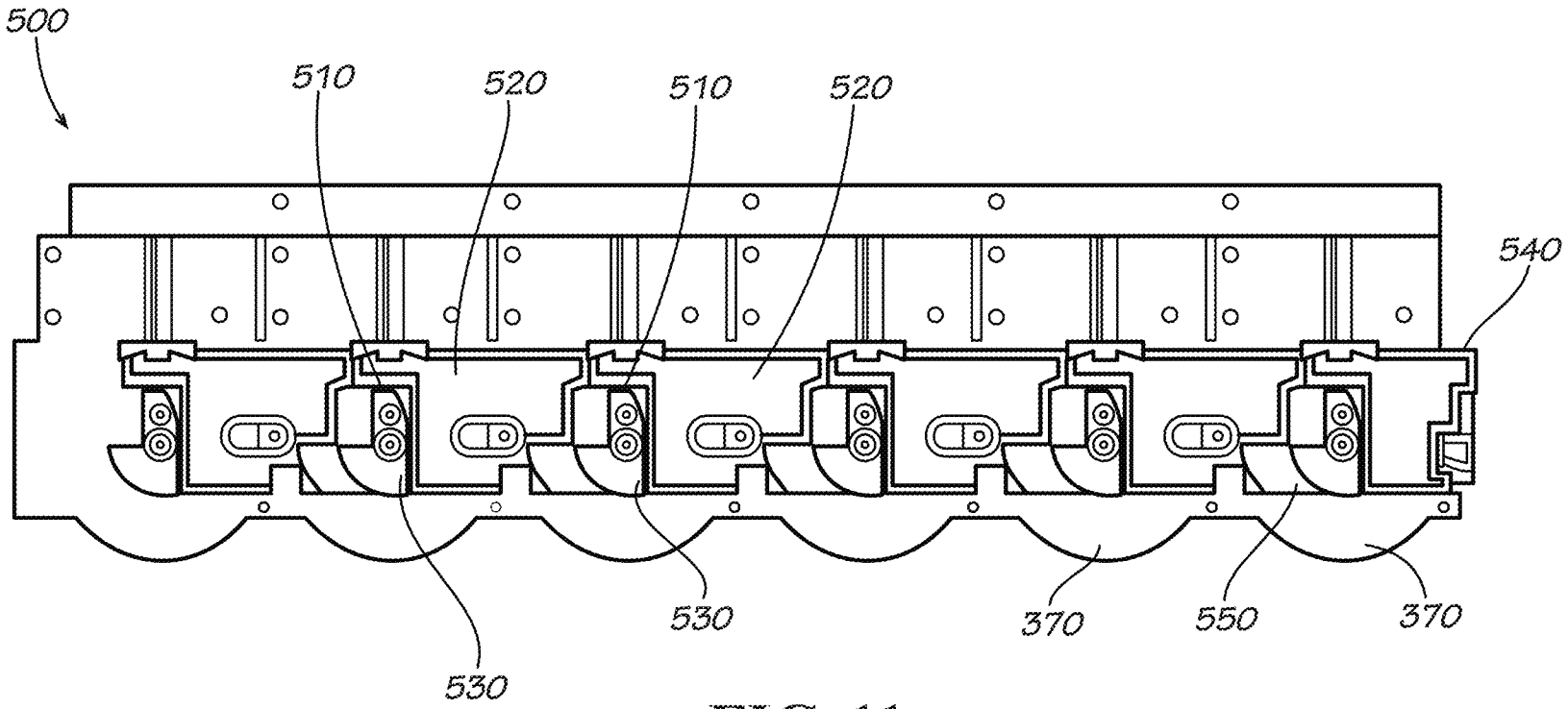
FIG. 11 is a top plan view of the product gate locking system in a closed position.

As is shown in FIG. 11, the vending device 300 of the vendor 100 also may include a product shelf locking system 500 associated with the product gate systems 360. The product shelf locking system 500 prevents the remaining product gates 370 on a given product shelf 320 from opening once any one product gate 370 on the product shelf 320 is opened.

Figure 12:
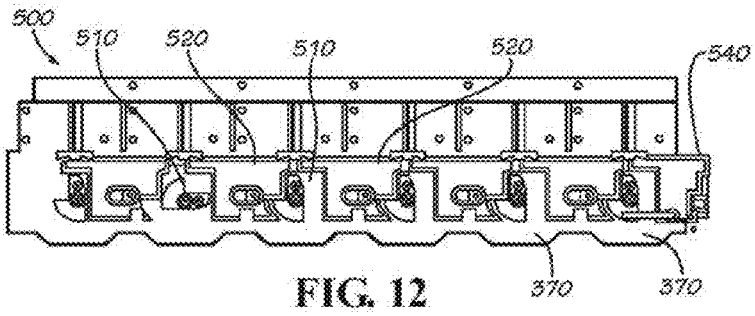
FIG. 12 is a top plan view of the product gate locking system with one product gate open.

The product shelf locking system 500 may include a number of cams 510. The cams 510 may be attached to the base 390 of each product gate system 360 for rotation therewith. The product shelf locking system 500 also may include a number of cursors 520 or other type of movable position marker positioned about each set of cams 510. The cams 510 and the cursors 520 may have any desired size or shape. A cam spring 530 also may be attached to each cam 510 to return the cam 510 to its original position. The product shelf locking system 500 also may include an end cursor 540 positioned on one end thereof and having a cursor spring 550 attached to the adjacent cam 510. Rotation of any one of the product gates 570 also causes the related cam 510 to rotate as is shown in FIG. 12. This rotation pushes the remaining cursors 520 to the right such that their related cams 510 are blocked from rotation. This blocking thus prevents the remaining product gates 370 from rotating. As such, once one product gate 370 on a given product shelf 320 is rotated, then the remaining product gates 370 are locked. Other configurations may be used herein.

FIGS. 13-16 show an alternative embodiment of a product gate system 600. The product gate system 600 includes any number of product vending modules 610 with two such modules 612, 614 shown herein for purposes of example only. Each product vending module 610 may include an angled product row 620. Each angled product row 620 may be defined by a shelf floor 630 and one or more lateral walls 640. A number of the products 10 may be positioned within the angled product row 620 for gravity feeding therein. The angled product rows 620 may have any angle sufficient for gravity feeding. A number of product vending modules 610 may share a common shelf floor 630 and the lateral walls 640.

The product vending module 610 may include a vending frame 650. The vending frame 650 may be positioned about an end of the angled product row 620. The vending frame 650 may define a product area 660 for one of the products 10. The vending frame 650 may be enclosed by a product gate 670. The product gate 670 preferable may be made from a transparent material such that the products 10 therein may be visible in whole or in part. The product gate 670 may have a somewhat convex shape and may extend for about the length of the product 10 intended to be positioned therein and/or the length of the vending frame 650. Other components and other configurations may be used herein.

Each product gate 670 may include a largely vertically extending door 680 positioned on a pivoting base 690. Although the base 690 is shown as largely circular in shape, any size or shape may be used herein. The product vending module 610 also includes a support base 700. The support base 700 supports the vending frame 650 and the door 680 and the base 690 of the product gate 670. Other components and other configurations may be used herein.

Referring now to FIGS. 17-20, the product vending module 610 also may include a product locking system 710. The product locking system 710 may be positioned within the support base 700 so as to cooperate with the door 680 and the base 690 of the product gate 670. The product locking system 710 may include a latch 720 positioned about the base 690. The latch 720 may include a number of cam anus 730. The cam arms 730 may cooperate with and travel along a number of cam tracks 740 extending from the base 690. The latch 720 may be operated by a solenoid 750 and may be biased into a desired position via a latch spring 760. The base 690 likewise may be biased into position via a base spring 770. Other components and other configurations may be used herein.

The product locking system 710 also may include a micro-switch 780. The micro-switch 800 may be positioned about the base 690 and may include a switch arm 790 that rides along the cam tracks 740 thereof so as to determine the position and rotation of the base 690. Other configurations and other components may be used herein. The micro-switch 780 may be in communication with the control 270. A damper 785 also may be used about the base 690.

Figure 13:
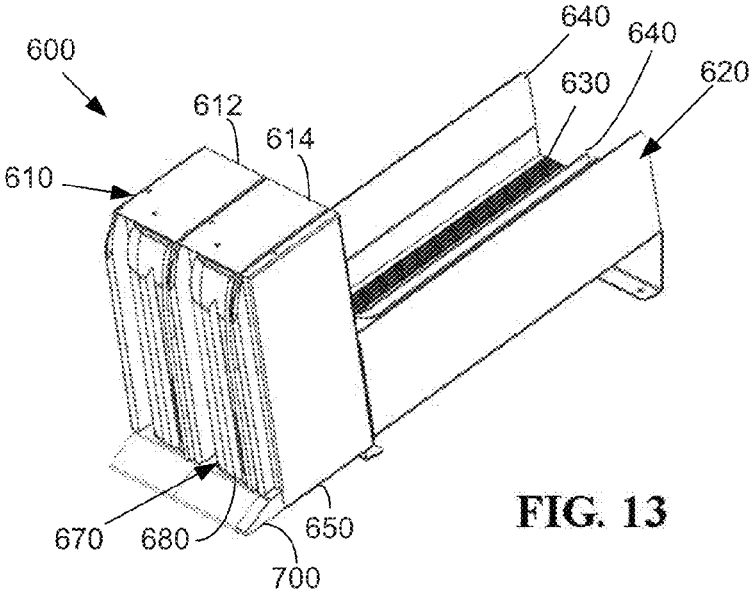
FIG. 13 is a perspective view of an alternative product gate system with a number of product vending modules as may be described herein.
Figure 14:
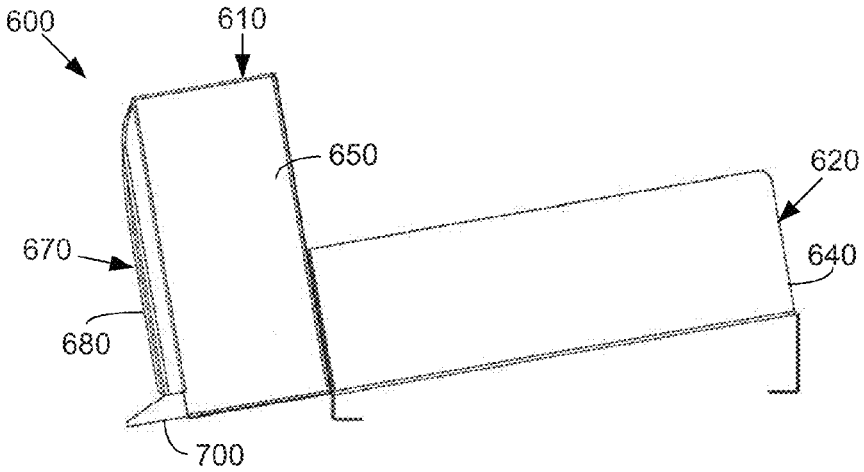
FIG. 14 is a side plan view of the product vending modules of FIG. 13.
Figure 15:
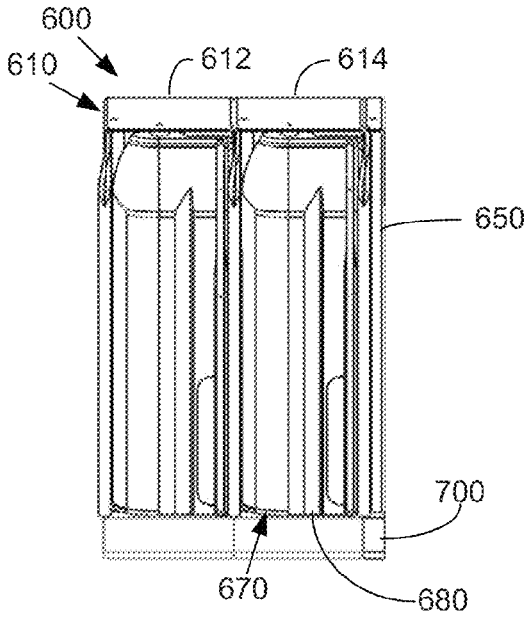
FIG. 15 is a front plan view of the product vending modules of FIG. 13 in the closed position.
Figure 16:
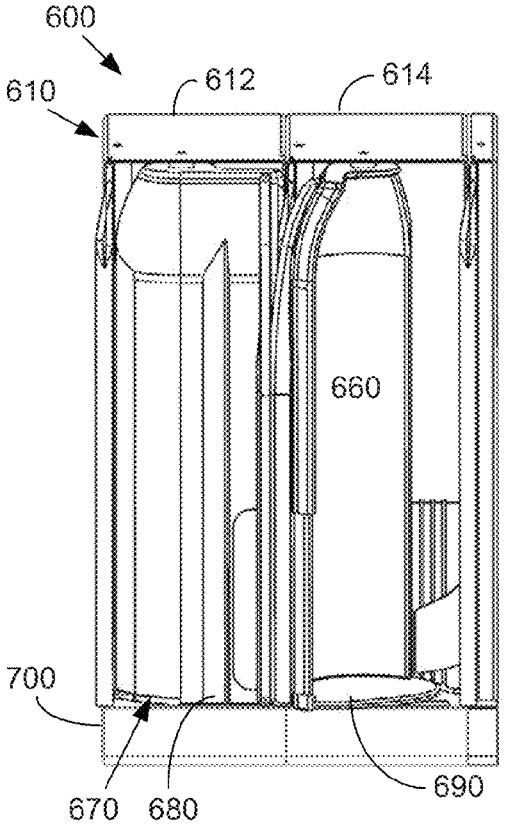
FIG. 16 is a front plan view of the product vending modules of FIG. 13 with one product gate in the opened position.
Figure 17:
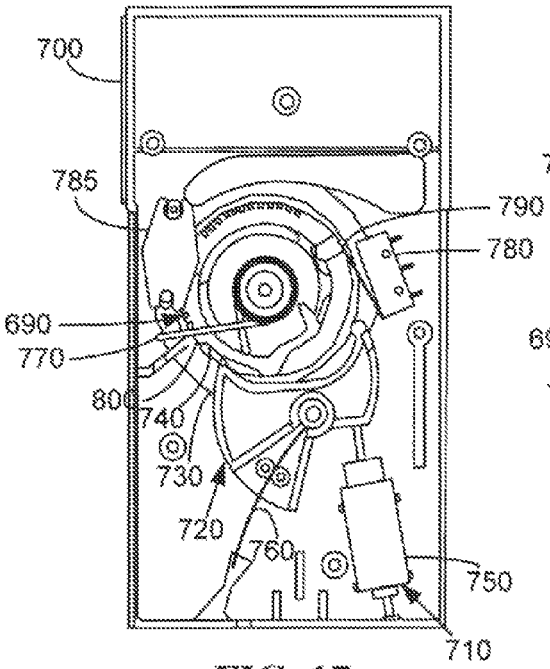
FIG. 17 is a bottom plan view of the product locking system of the product vending module of FIG. 13 in the closed position.
Figure 18:
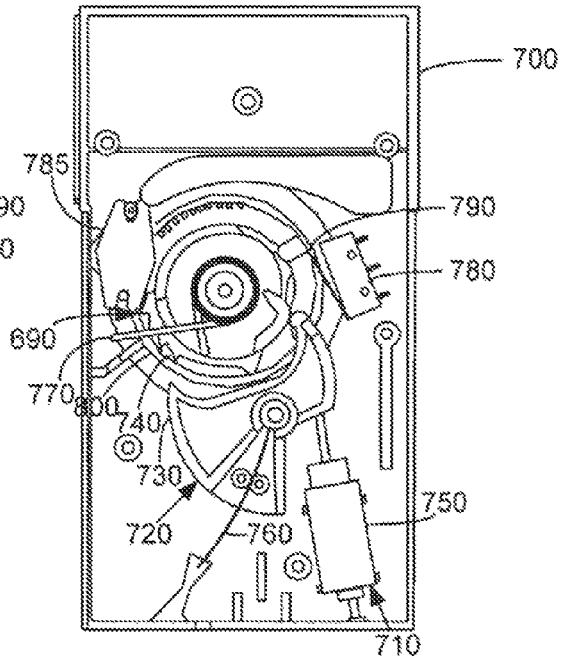
FIG. 18 is a is a bottom plan view of the product locking system of the product vending module of FIG. 13 moving from the closed position to the opened position.
Figure 19:
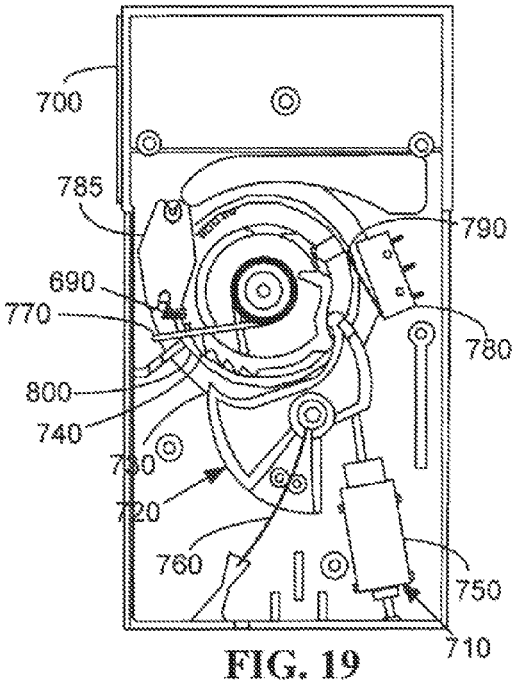
FIG. 19 is a bottom plan view of the product locking system of the product vending module of FIG. 13 in the opened position.

In use, FIGS. 13, 15, and 17 show an example of the product vending module 610 in a closed and locked position. The base 690 and the door 680 of the product gate 670 are locked. Upon receipt of an appropriate amount of credit as is described in more detail below, the control 270 may "arm" the solenoid 750 adjacent to the latch 720. Once the micro-switch 780 detects a small amount of movement of the base 690 caused by the opening of the door 680, the solenoid 760 releases the latch 720 so as to allow the base 690 to rotate as is shown in FIG. 18. The control 270 also guarantees that no two solenoids 750 may be open at one time. As is shown in FIG. 19, further opening of the door 680 and rotation of the base 690 mechanically pushes the latch 720 back into positioned via the cam track 740 and the latch spring 760. The product 10 may now be removed from the product area 660 as is shown in FIG. 16. The curvature of the door 680 prevents access to the next product 10 on the angled product row 620.

Figure 20:
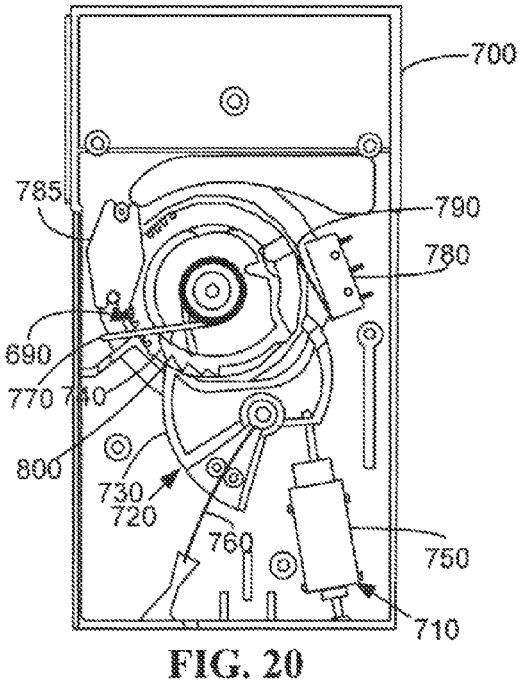
FIG. 20 is a is a bottom plan view of the product locking system of the product vending module of FIG. 13 moving from the opened position to the closed position.

FIG. 20 shows the door 680 of the product gate 670 returning to the closed and locked position. The base 690 and the door 680 may rotate back to the original position via the base spring 770. Further opening of the door 680 may be prevented by a number of ratchets 800 positioned on the cam tracks 740 that interact with the cam arms 730 of the latch 720. The next product 10 may move into the product area 660 under the force of gravity once the door 680 clears the angled product row 620.

Figure 21:
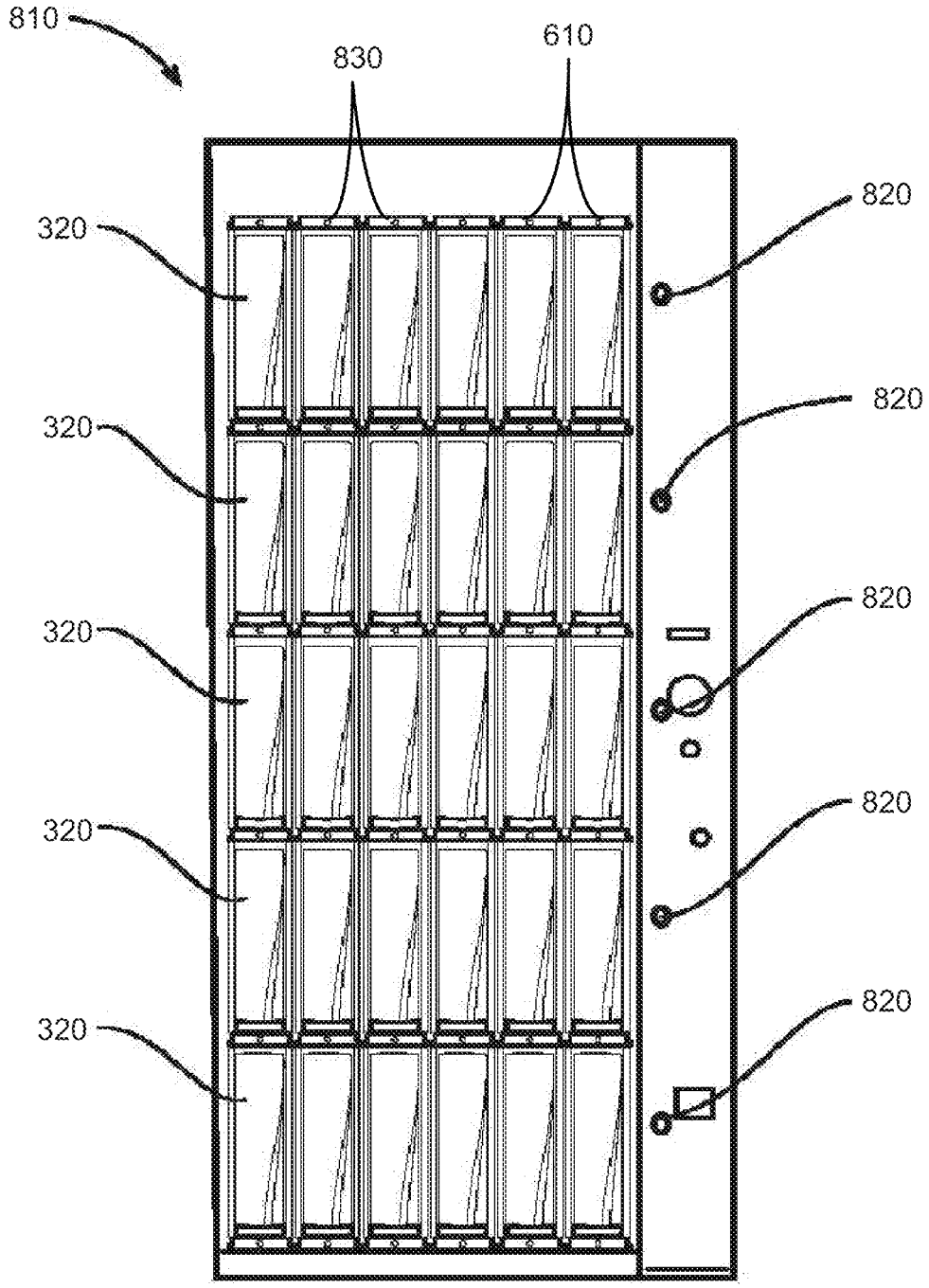
FIG. 21 is a front plan view of a vendor as may be described herein with number of the product vending modules therein.

FIG. 21 shows a vendor 810 with a number of the product vending modules 610 positioned therein. In this example, a selection button 820 may be positioned about each product shelf 320. When credit has been established equal to the selected price for that product shelf 320, the selection button 820 may flash so as to indicate that the products 10 therein are available. The lighted selection button 820 thus indicates that the consumer may select a product 10 from that particular product shelf 320. The solenoids 750 for each product vending module 610 thus may be armed when the appropriate credit is entered. Opening the door 680 of any of the product vending modules 610 triggers the solenoid 750 therein to open the latch 720 while disarming the remaining solenoids 750 such that no other door 680 may be opened. The vend may be considered complete as the door 680 is rotated to the open position. The product 10 then may be removed and the product gate 670 may rotate shut. The consumer must open the door 680 by a sufficient degree of rotation to remove the product 10 therein for the vend to be considered complete. Alternatively, each product vending module 610 also may have an individual selection button 830 such that each product vending module 610 may be set at different price. Other configurations and other components also may be used herein.

Each product vending module 610 may be removable for easy reloading. Alternatively, an entire shelf 320 of the product vending modules 610 also may be removable. The product vending module 610 may accommodate different row widths, different row heights, and different packaging sizes while using the same product locking system 710. The vendors 100 described herein thus provide a low cost but flexible vending machine for lower volume locations and the like. The visibility of a glass door cooler is provided with simplified vending mechanisms for appropriate control and safety.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A product vending module for vending a number of products, the product vending module comprising:

a product row configured to contain a number of products therein;

a product gate positioned about the product row and rotatable from a closed position preventing access to the number of products to an open position allowing access to one of the number of products while preventing access to a remainder of the number of products, the product gate comprising a biased base; and a product locking system in communication with the product gate, the product locking system comprising:

a latch releasably engaging the biased base and movable from an engaged position restricting rotation of the product gate to a released position allowing rotation of the product gate;

a solenoid in communication with the latch and configured to move the latch from the engaged position to the released position;

a micro-switch in communication with the biased base and configured to detect rotation of the product gate; and a control in communication with the solenoid and the micro-switch, wherein the control is configured to activate the solenoid to move the latch from the engaged position to the released position when the micro-switch detects rotation of the product gate.

2. The product vending module of claim 1, wherein the product row comprises an angled product shelf configured for gravity feeding of the number of products toward the product gate.

3. The product vending module of claim 1, wherein the product gate further comprises a door extending from the biased base, wherein the door prevents access to the number of products when the product gate is in the closed position, and wherein the door allows access to the one of the number of products while preventing access to the remainder of the number of products when the product gate is in the open position.

4. The product vending module of claim 3, wherein the door comprises a convex door.

5. The product vending module of claim 3, wherein the door comprises a transparent door.

6. The product vending module of claim 1, wherein the latch comprises one or more cam arms releasably engaging the biased base.

7. The product vending module of claim 6, wherein the biased base comprises one or more cam tracks that cooperate with the one or more cam arms.

8. The product vending module of claim 7, wherein the one or more cam tracks comprise a plurality of ratchets.

9. The product vending module of claim 1, wherein the latch is spring biased to the engaged position.

10. The product vending module of claim 1, wherein the biased base is spring biased to rotate the product gate to the closed position.

11. The product vending module of claim 3, wherein the door is positioned at least partially between the one of the number of products and the remainder of the number of products when the product gate is in the open position.

12. A method of vending a number of products, the method comprising:

providing a plurality of product vending modules, the plurality of product vending modules each comprising:

a product row containing a number of products therein;

a product gate positioned about the product row and rotatable from a closed position preventing access to the number of products to an open position allowing access to one of the number of products while preventing access to a remainder of the number of products, the product gate comprising a biased base; and a product locking system in communication with the product gate, the product locking system comprising a latch releasably engaging the biased base and movable from an engaged position restricting rotation of the product gate to a released position allowing rotation of the product gate;

detecting movement of the product gate of one of the plurality of product vending modules;

moving the latch of the one of the plurality of product vending modules to the released position so as to allow rotation of the product gate of the one of the plurality of product vending modules to the open position; and maintaining the latches of a remainder of the plurality of product vending modules in the engaged position.

13. A vendor for vending a number of products, the vendor comprising:

a plurality of product vending modules, the plurality of product vending modules each comprising:

a product row configured to contain a number of products therein;

a product gate positioned about the product row and rotatable from a closed position preventing access to the number of products to an open position allowing access to one of the number of products while preventing access to a remainder of the number of products, the product gate comprising a biased base; and a product locking system in communication with the product gate, the product locking system comprising a latch releasably engaging the biased base and movable from an engaged position restricting rotation of the product gate to a released position allowing rotation of the product gate; and a control in communication with each of the plurality of product vending modules and configured such that upon movement of the product gate of one of the plurality of product vending modules, the control causes the latch of the one of the plurality of product vending modules to move to the released position while the latches of a remainder of the plurality of product vending modules are maintained in the engaged position.

14. The vendor of claim 13, wherein the product gate further comprises a door extending from the biased base, wherein the door prevents access to the number of products when the product gate is in the closed position, and wherein the door allows access to the one of the number of products while preventing access to the remainder of the number of products when the product gate is in the open position.

15. The vendor of claim 13, wherein the product locking system further comprises a solenoid in communication with the latch and the control, and wherein the solenoid is configured to move the latch from the engaged position to the released position.

16. The vendor of claim 13, wherein the product locking system further comprises a micro-switch in communication with the biased base and the control, and wherein the micro-switch is configured to detect rotation of the product gate.

17. The vendor of claim 13, wherein the latch comprises one or more cam arms releasably engaging the biased base, and wherein the biased base comprises one or more cam tracks that cooperate with the one or more cam arms.

* * * * *